US011371331B2

(12) United States Patent
Surjaatmadja et al.

(10) Patent No.: US 11,371,331 B2
(45) Date of Patent: Jun. 28, 2022

(54) INJECTION VALVE FOR INJECTING RANDOMLY SIZED AND SHAPED ITEMS INTO HIGH PRESSURE LINES

(71) Applicant: Halliburton Energy Services, Inc., Houston, TX (US)

(72) Inventors: Jim B. Surjaatmadja, Duncan, OK (US); Timothy H. Hunter, Duncan, OK (US); Stanley V. Stephenson, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/761,922

(22) PCT Filed: Dec. 28, 2017

(86) PCT No.: PCT/US2017/068638
§ 371 (c)(1),
(2) Date: May 6, 2020

(87) PCT Pub. No.: WO2019/132907
PCT Pub. Date: Jul. 4, 2019

(65) Prior Publication Data

US 2021/0172307 A1 Jun. 10, 2021

(51) Int. Cl.
*E21B 43/267* (2006.01)
*E21B 43/114* (2006.01)
*E21B 43/04* (2006.01)

(52) U.S. Cl.
CPC ..... *E21B 43/267* (2013.01); *E21B 43/114* (2013.01)

(58) Field of Classification Search
CPC ..... E21B 43/26; E21B 43/267; E21B 41/00; E21B 34/02; E21B 44/00; E21B 34/08; E21B 49/008; E21B 34/00; E21B 47/00; E21B 43/04
See application file for complete search history.

(56) References Cited

U.S. PATENT DOCUMENTS

| | | | | |
|---|---|---|---|---|
| 4,623,303 | A | 11/1986 | Henderson | |
| 9,375,761 | B1 | 6/2016 | Dawson | |
| 2007/0209615 | A1 | 9/2007 | Epshteyn | |
| 2011/0155392 | A1 | 6/2011 | Frazier | |
| 2012/0164000 | A1* | 6/2012 | Bottos | F04B 15/04 417/53 |
| 2014/0090851 | A1 | 4/2014 | Tips et al. | |
| 2014/0124208 | A1 | 5/2014 | Loree | |
| 2014/0290956 | A1 | 10/2014 | Burnette | |

(Continued)

OTHER PUBLICATIONS

International Search Report and Written Opinion dated Sep. 19, 2018 for PCT Application No. PCT/US2017/067971 filed Dec. 28, 2017 (14 pages).

*Primary Examiner* — Zakiya W Bates
(74) *Attorney, Agent, or Firm* — K&L Gates LLP

(57) ABSTRACT

A fluid injection system for injecting a particulate in a fluid, including a high-pressure pump operable to output the fluid from an outlet flow channel and a reservoir configured to hold the particulate. The system also includes a valve assembly in fluid communication with the reservoir and the outlet flow channel of the pump, the valve assembly operable to discharge the particulate into a fluid stream output by the pump while the reservoir is sealed from the outlet flow channel of the pump.

20 Claims, 5 Drawing Sheets

(56) References Cited

U.S. PATENT DOCUMENTS

| | | | | |
|---|---|---|---|---|
| 2014/0311334 | A1 | 10/2014 | Bartholomeus | |
| 2015/0041133 | A1 | 2/2015 | Chauffe | |
| 2015/0060064 | A1* | 3/2015 | Lafferty | E21B 43/267 166/280.1 |
| 2015/0114671 | A1 | 4/2015 | Vanburen | |
| 2015/0275869 | A1 | 10/2015 | Muth | |
| 2015/0275889 | A1 | 10/2015 | Muth | |
| 2016/0177675 | A1 | 6/2016 | Morris et al. | |
| 2016/0305411 | A1 | 10/2016 | Drake | |

* cited by examiner

INJECTION VALVE FOR INJECTING RANDOMLY SIZED AND SHAPED ITEMS INTO HIGH PRESSURE LINES

BACKGROUND

This section is intended to provide relevant background information to facilitate a better understanding of the various aspects of the described embodiments. Accordingly, it should be understood that these statements are to be read in this light and not as admissions of prior art.

Hydrocarbon-producing wells may be stimulated by hydraulic fracturing operations, wherein a fracturing fluid is introduced into a hydrocarbon-producing zone within a subterranean formation at a hydraulic pressure sufficient to create or enhance at least one fracture therein. One hydraulic fracturing technique involves discharging a work string fluid through a jetting tool against the subterranean formation while simultaneously pumping an annulus fluid down the annulus surrounding the work string between a work string and the subterranean formation. The stimulation fluid may be jetted against the subterranean formation at a pressure sufficient to perforate the casing and cement sheath (if present) and create cavities in the subterranean formation. Once the cavities are sufficiently deep, jetting the stimulation fluid into the cavities usually pressurizes the cavities. Simultaneously, the annulus fluid may be pumped into the annulus at a flow rate such that the annulus pressure plus the pressure in the cavities is at or above the fracture initiation pressure so that the cavities may be enlarged or enhanced. As referred to herein, the "fracture initiation pressure" is defined to mean the pressure sufficient to enhance (e.g., extend or enlarge) the cavities. The cavities or perforations are enhanced, inter alia, because the annulus pressure plus the pressure increase caused by the jetting, e.g., pressure in the cavities, is above the required hydraulic fracturing pressure.

Generally, the stimulation fluid suspends particulate propping agents, commonly referred to collectively as "proppant," that are placed in the fractures to prevent the fractures from fully closing (once the hydraulic pressure is released), thereby forming "propped fractures" within the formation through which desirable fluids (e.g., hydrocarbons) may flow. The conductivity of these propped fractures may depend on, among other things, fracture width and fracture permeability.

In other well treatment processes, injection may be done to plug a cavity to eliminate unwanted leakoff. In these applications, a mixture of large and small particles may be injected. In general, the first particles are "as large as possible" to bridge the opening; and followed by a smaller size, not less than ⅓ size, and smaller and smaller until it is a fine powder. In other applications, such materials could be degradable, so they disappear after some amount of time; or they could be permanent.

BRIEF DESCRIPTION OF THE DRAWINGS

Embodiments are described with reference to the following figures. The same numbers are used throughout the figures to reference like features and components. The features depicted in the figures are not necessarily shown to scale. Certain features of the embodiments may be shown exaggerated in scale or in somewhat schematic form, and some details of elements may not be shown in the interest of clarity and conciseness.

DETAILED DESCRIPTION

Figure 1:
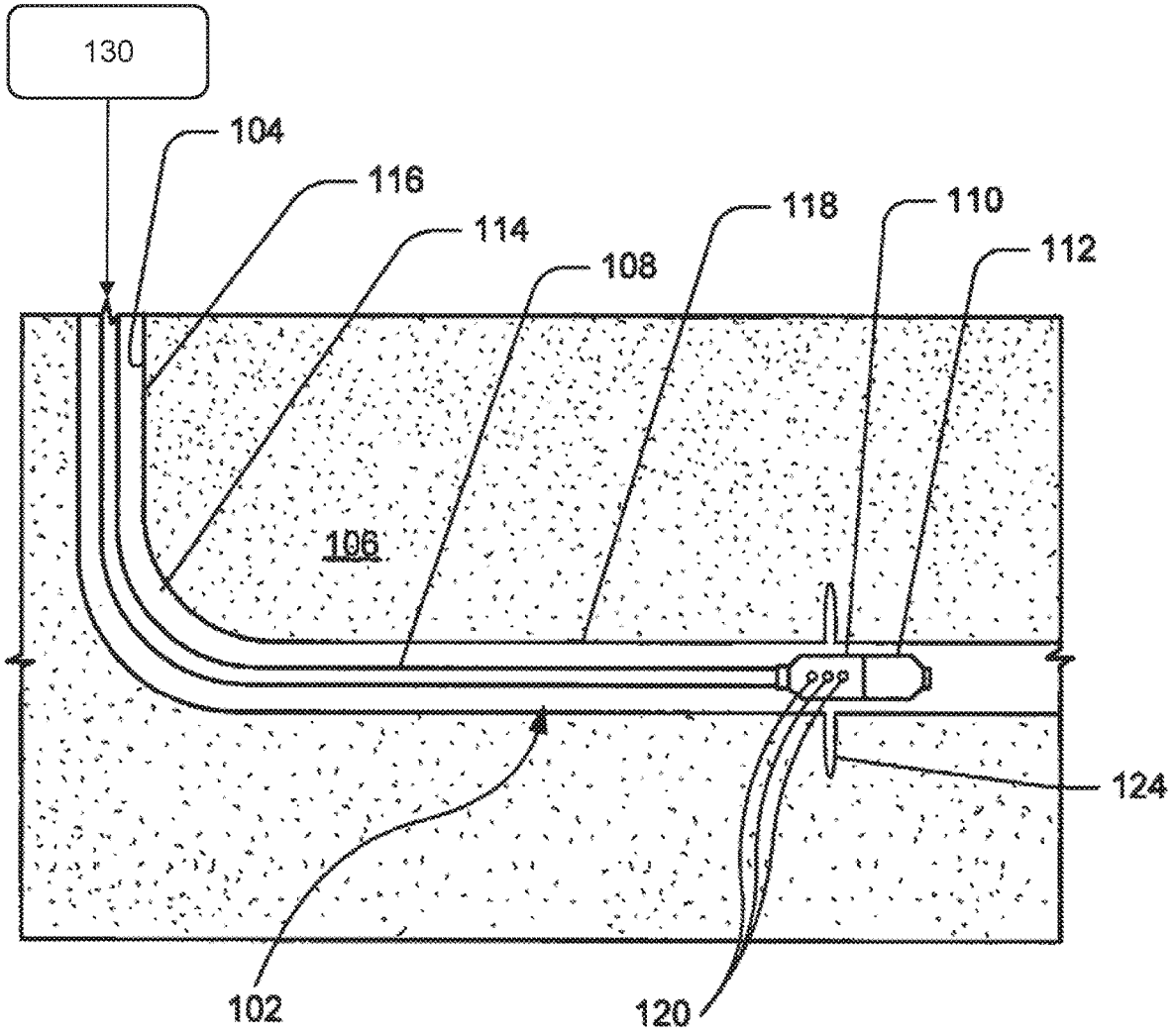
FIG. 1 depicts an elevation view of a well system, according to one or more embodiments.

FIG. 1 depicts an elevation view of a stimulation system 102 in accordance with one or more embodiments of the present disclosure. As shown, the stimulation system 102 is located in a wellbore 104 that penetrates a subterranean formation 106. The wellbore 104 includes a generally vertical portion 116, which extends to the ground surface (not shown), and a generally horizontal portion 118, which extends into the subterranean formation 106. Even though FIG. 1 depicts the wellbore 104 as a deviated wellbore with a generally horizontal portion 118, the methods of this disclosure may be performed in a generally vertical, inclined, or otherwise formed portions of wells. In addition, the wellbore 104 may include multilaterals, wherein the wellbore 104 may be a primary wellbore having one or more branch extending therefrom, or the wellbore 104 may be a branch extending laterally from a primary wellbore. Furthermore, the wellbore 104 may be openhole as shown in FIG. 1 or lined with casing (not shown The stimulation system 102 includes a work string 108, in the form of piping or coiled tubing, a jetting tool 110 coupled at an end thereof, an optional valve subassembly 112 coupled to an end of the jetting tool 110, and a fluid injection system 130. An annulus 114 is formed between the subterranean formation 106 and the work string 108, the jetting tool 110, and the valve subassembly 112.

The jetting tool 110 may be any suitable assembly for use in subterranean operations through which a fluid may be jetted at high pressures. Generally, the jetting tool 110 has a plurality of ports 120 extending therethrough for discharging a stimulation fluid out of the jetting tool 110 against the subterranean formation 106. In some embodiments, the plurality of ports 120 may form discharge jets as a result of a high pressure stimulation fluid being forced out of relatively small ports. In other embodiments, the jetting tool 110 may have fluid jet forming nozzles (not shown) connected within the plurality of ports 120.

The stimulation fluid may be injected into the work string 108 and discharged from the jetting tool 110 by a fluid injection system 130 as further described herein. The fluid injection system 130 is operably connected to a wellhead (not shown) located at the surface to inject the stimulation fluid into the wellbore 104. The fluid injection system 130 discharges a particulate (not shown) into the fluid stream output by a pump (not shown) to provide a fluid-particulate mixture, which enables the injection of the particulate into generally large fractures. The fluid may be any type of fluid suitable for formation stimulation, including chemicals designed to treat the formation. For stimulation purposes, particulate matter is generally small, such as 0.01 mm to 5 mm in diameter. The particles are generally sequenced from small to big, the small ones used to reach as deep as possible since tip of the fractures are generally narrow. Other techniques would also create unpredictable mixtures to randomly create bridges in the fracture. In general, these type proppants are pumpable using commonly used fracturing pumps; but yet, sometimes it is preferred to just pump clean fluid, and the injector is tasked with pumping the abrasive fluid. This is to extend the life of the fracturing pump. Sometimes, the particulate matter sticks on the valves of the frac pumps, and causes permanent damage. When dealing with such proppants, the injector is used as the slow positive closure systems are much more resistant to these type materials.

The particulate may be randomly sized, i.e., different sizes and shapes. The particulate may be any one or combination of rocks, sand, or proppant. The particulate may also have a dimension (e.g., width or height) of 0.0004 inch (0.001 cm) to 5 mm. This type of particulate enables the injection of proppant into large fractures that exceed 2 or more inches (5 cm) in width. Alternatively, this type of particulate facilitates the plugging of fractures in portions of the formation that may no longer be suitable for production or fractures that exceed 2 or more inches (5 cm) in width. This type of particulate may also facilitate plugging of fractures that leak into a salt mine. Many times, plugging agents like this are larger than 3-4 inches (as long as it fits the casing string) and followed with smaller sizes as a mix to completely plug the opening. Oftentimes, the proppants could be shaped oblong, long strings, or any other shapes. These shapes generally create issues with conventional pumps, yet may be handled using the disclosed injector system.

Figure 2A:
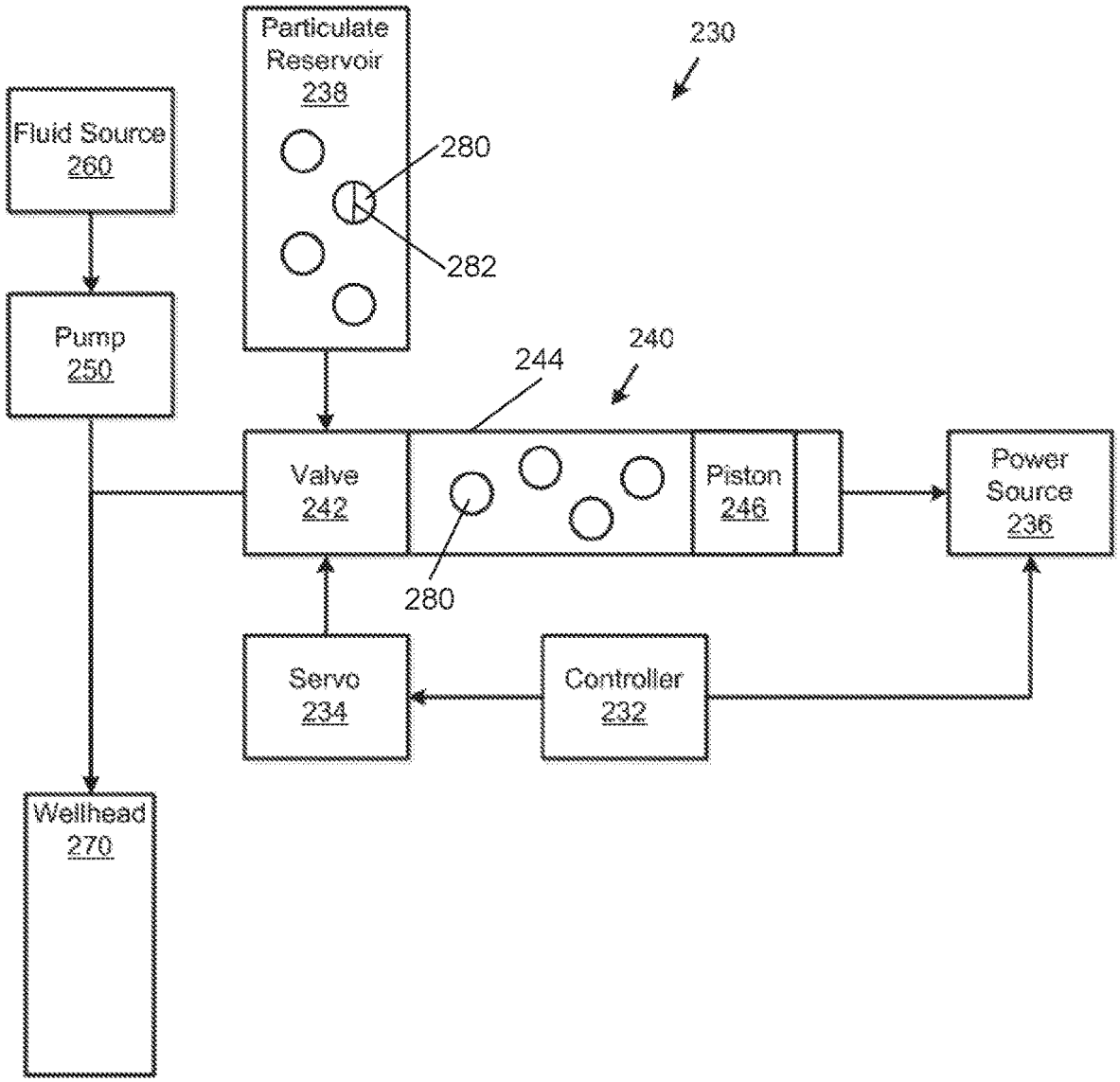
FIGS. 2A and 2B depict block diagrams of a fluid injection system, according to one or more embodiments.

FIGS. 2A and B show block diagrams of a fluid injection system 230, in accordance with one or more embodiments. The fluid injection system 230 includes a controller 232, a servomotor 234, a valve assembly 240, a power source 236, a particulate reservoir 238, a high-pressure pump 250, and a fluid source 260. In this illustration, the fluid injection system 230 is in fluid communication with a wellhead 270 to inject a fluid-particulate mixture into a well through the wellhead 270. The wellhead 270 may be a system of spools, valves, and assorted adapters that provide pressure control of the well. The fluid injection system 230 may be used in hydraulic fracturing operations to deliver rocks, sand, or proppant to fractures formed in the subterranean formation. The fluid injection system 230 may inject the fluid-particulate mixture into a work string (108 of FIG. 1) attached to the wellhead 270 and discharge the fluid-particulate mixture into a fracture using a jetting tool as depicted in FIG. 1. For example, the fluid injection system 230 may inject the fluid-particulate mixture into the well to prop open fractures that exceed 2 or more inches (5 cm) in width. However, it should be appreciated that the fluid injection system 230 may be used to inject or discharge a fluid-particulate mixture into other pipelines or for any suitable application, including but not limited to injecting cement or sealing fractures in salt mines.

As shown in FIG. 2A, the ports (not shown) of the valve assembly 240 are set to allow the particulate 280 from the particulate reservoir 238 to enter the chamber 244. Whereas, in FIG. 2B, ports of the valve assembly 240 are set to discharge the particulate 280 into the wellhead 270. The valve assembly 240 includes a valve 242, a chamber 244, and a piston or plunger 246, which is operably connected to the chamber 244 to reciprocate in the chamber 244. The valve assembly 240 extracts the particulate 280 from the particulate reservoir 238 (FIG. 2A) and discharges the particulate 280 into the fluid output by the pump 250 (FIG. 2B) as further described herein. The valve assembly 240 enables the particulate 280 to be mixed with the fluid output by the pump 250 without the particulate 280 actually entering the pump 250. This prevents the pump 250 from being subjected to the potentially damaging effects of the particulate 280.

The particulate reservoir 238 holds a supply of the particulate 280 to be discharged into the fluid stream of the pump 250 and may be any closed or open container capable of holding the particulate 280. The particulate 280 may have a dimension 282 (e.g., width or height) of 0.0004 inch (0.001 cm) to 4 inches or 100 mm or any dimension that is smaller than a corresponding dimension of the piston or plunger 246 and smaller than the wellbore 116.

The controller 232 automates the operation of the fluid injection system 230 to discharge the particulate 280 into the fluid stream output by the pump 250. The controller 232 is connected with and transmits a control signal to the servomotor 234, which orients the ports of the valve 242 depending on the stroke of the piston or plunger 246 included with the valve assembly 240, as further described with respect to FIGS. 3A-3C. The controller 232 also transmits a control signal to the power source 236 to adjust the stroke rate of the piston or plunger 246 included with the valve assembly 240.

The controller 232 may be a computing device, such as a computer, microcontroller, or microprocessor. The controller 232 includes one or more processors (not shown) and memory (e.g., ROM, EPROM, EEPROM, flash memory, RAM, a hard drive, a solid-state disk, an optical disk, or a combination thereof) capable of executing instructions to automate the operation of the fluid injection system 230. Software stored on the memory controls the operation of the fluid injection system 230 as further described herein. It should be appreciated that the controller 232 may be located remotely from the fluid injection system 230 and operably connected to the servomotor 234 and power source 236.

Figure 2B:
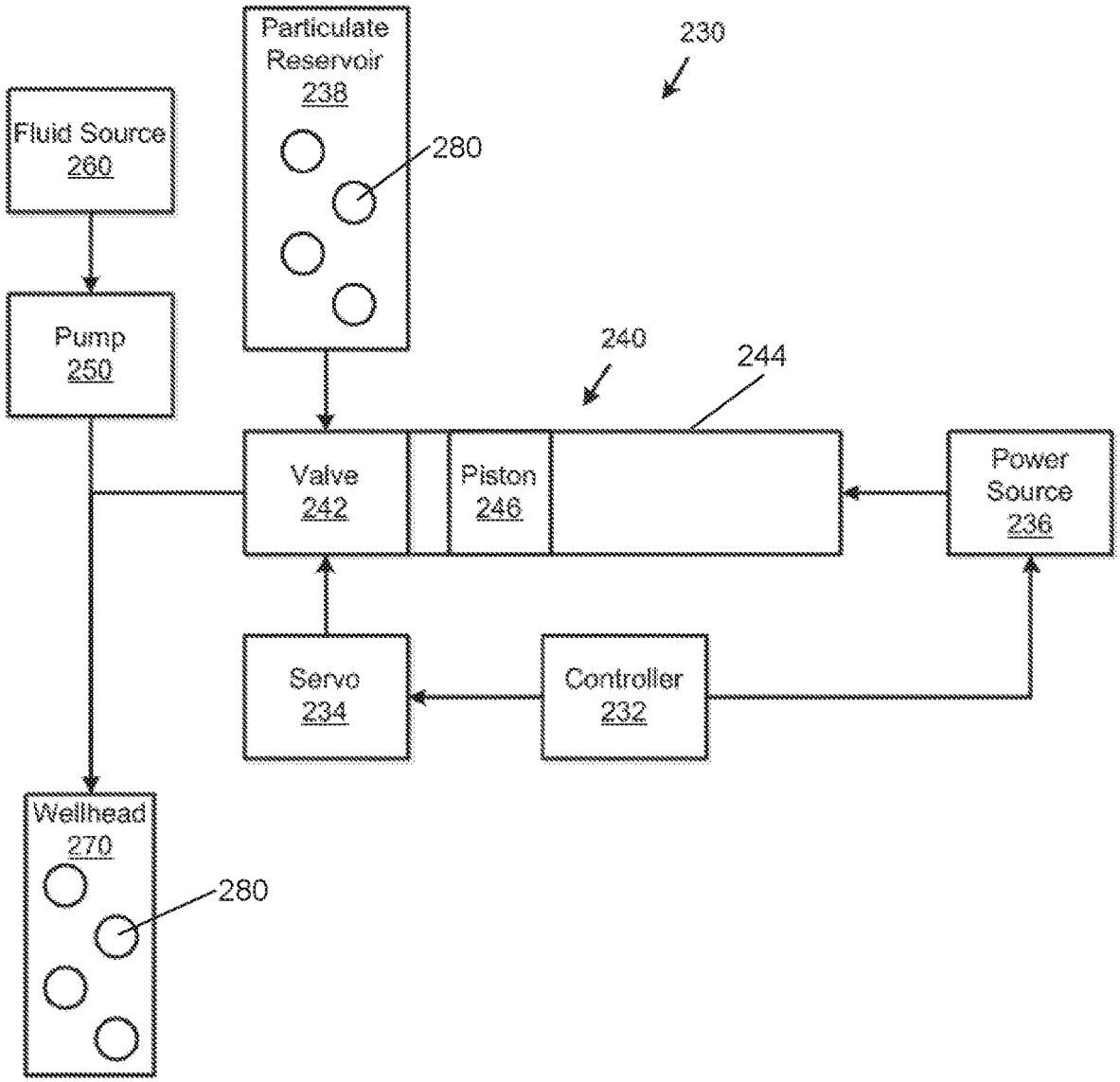
Figure 3A:
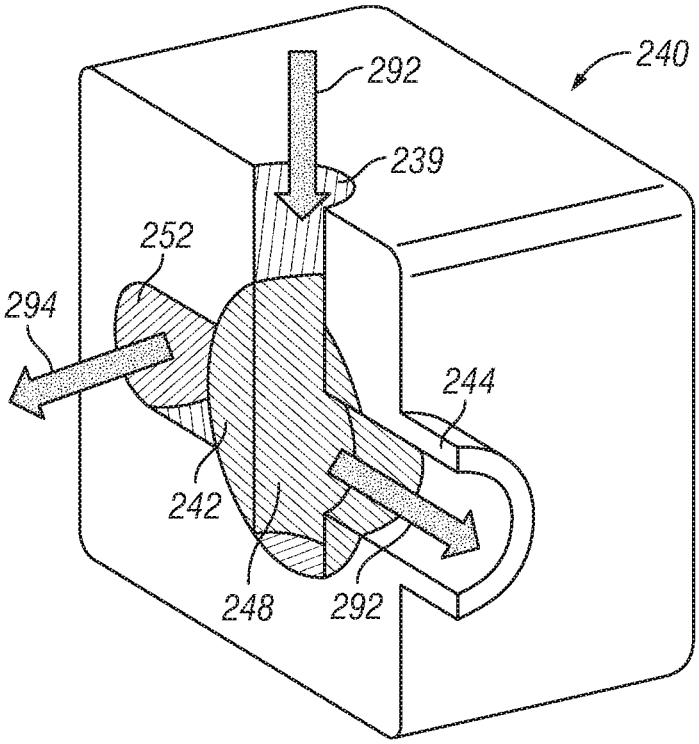
FIGS. 3A-C depict isometric cross-sections of a valve assembly employed with the fluid injection system, according to one or more embodiments.
Figure 3B:
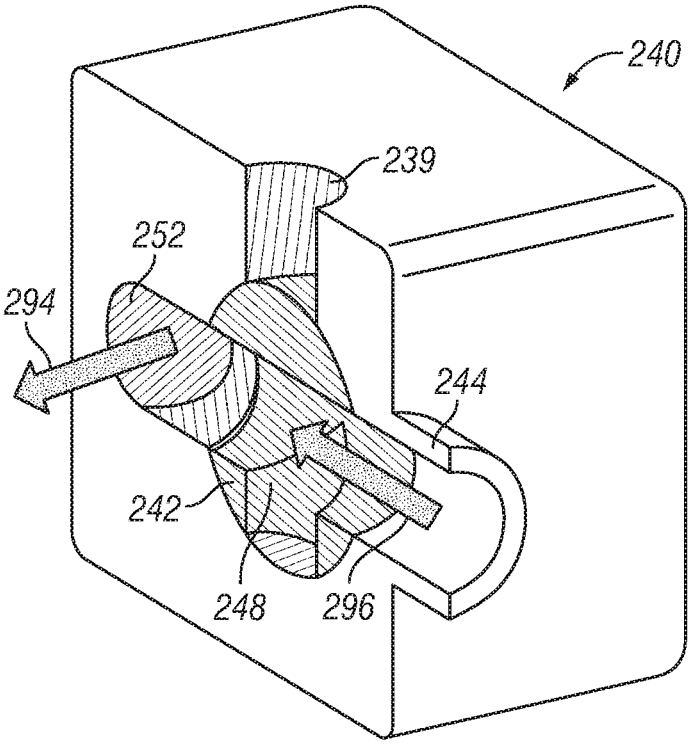
Figure 3C:
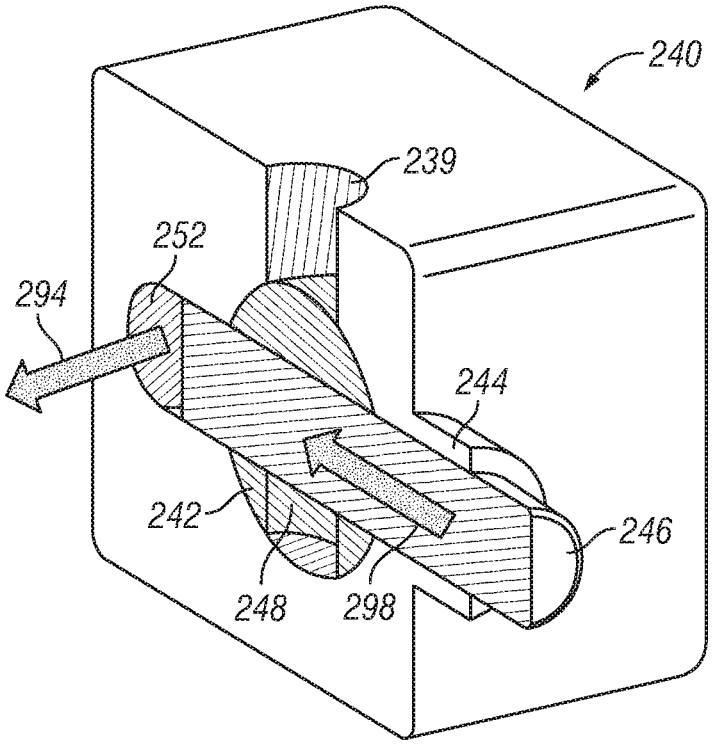

The servomotor 234 receives the control signal from the controller 232 and orients the ports of the valve 242 included with the valve assembly 240 as further described with respect to FIGS. 3A-3C. For example, the servomotor 234 may orient the ports of the valve 242 such that the particulate reservoir 238 is in fluid communication with the valve assembly 240 to fill the chamber 244 with the particulate 280 as depicted in FIG. 2A. The servomotor 234 then, at the direction of the controller 232, orients the ports of the valve 242 to be in fluid communication with the output flow channel of the pump 250 to discharge the particulate 280 in the chamber 244 into the fluid stream output by the pump 250 as depicted in FIG. 2B. The servomotor 234 is operably connected to the valve 242 and is a rotary or linear actuator operable to orient the ports of the valve 242.

The power source 236 provides the mechanical or hydraulic power to reciprocate the piston or plunger 246 included with the valve assembly 240. The piston or plunger 246 is used to extract the particulate 280 from the particulate reservoir 238 into the chamber 244 as the piston or plunger 246 strokes away from the valve 242 as depicted in FIG. 2A. As the piston or plunger 246 strokes away from the valve 242, a partial vacuum or low pressure region is generated in the chamber 244, pulling the particulate into the chamber 244. The piston or plunger then discharges the particulate 280 into the fluid output by the pump 250 as the piston or plunger strokes towards the valve 242 as depicted in FIG. 2B. The power source 236 may include an electric motor or a hydraulic pump. For example, a reciprocating output shaft of the power source 236 may be operably connected to the piston or plunger 246 to stroke the piston or plunger 246 within the chamber 244. As a pump, the power source 236 may generate a varying pressure differential across the piston or plunger to reciprocate the piston or plunger. As a non-limiting example, the power source 236 may be the HT-400™ pump available from Halliburton Energy Services, Inc. of Houston, Tex.

The pump 250 is a high-pressure pump that outputs a fluid from the fluid source 260, which may be any suitable container or supply of fluid. As shown in FIGS. 2A and B, the high-pressure pump 250 injects the fluid into the wellhead 270 as the valve assembly 240 introduces the particulate 280 into the fluid stream. The pump 250 is operably connected to the valve assembly 240 to receive the particulate 280 discharged from the valve assembly 240. The high-pressure pump 250 may operate to output fluid at a high pressure of 5,000 psi (34 MPa) to 30,000 psi (206 MPa) or greater. The pump 250 may be a network of high-pressure pumps operably connected to each other to output the fluid. As a non-limiting example, the pump may be a Q10™ Pumping Unit available from Halliburton Energy Service, Inc. of Houston, Tex.

FIGS. 3A-C depict isometric cross-sections of the valve assembly 240 employed to mix the particulate with the fluid output by the pump (not shown), in accordance with one or more embodiments. As shown in FIG. 3A, the valve 242 has T-shaped ports 248, which are rotatable. The valve 242 of FIG. 3A is oriented in the valve assembly 240 to extract particulate from the particulate reservoir (not shown). As the piston or plunger (not shown) strokes away from the valve 242, the particulate flows from the particulate reservoir (238 of FIG. 2A) through an upper flow channel 239 and then is directed into the chamber 244 by the valve 242. The direction of the particulate flow is indicated by arrows 292. Also shown in FIG. 3A is an output flow channel 252 of the pump (250 of FIG. 2A), and the direction of the fluid flow output by the pump is indicated by arrow 294. The valve 242 also seals off the chamber 244 from the output flow channel 252 to prevent the valve assembly 250 from disrupting the output of the fluid from the pump.

As shown in FIG. 3B, the ports 248 of the valve 242 are oriented to seal off the particulate reservoir from the chamber 244 and allow the particulate to enter the fluid stream of the pump in the output channel 252. The flow direction of the particulate is indicated by arrow 296. In this orientation of the ports 248, the piston or plunger (not shown) is stroked towards the valve 242 to discharge the particulate from the valve assembly 240. This results in the particulate mixing with the fluid stream output by the pump and being injected into the wellhead 270 of FIG. 2A. In FIG. 3C, the piston or plunger 246 is depicted as continuing to stroke through the ports 248 of the valve 242 to flush the particulate out of the valve 242. The stroke direction of the piston or plunger 246 is indicated by arrow 298. However, the controller 232 of FIG. 2A may adjust the stroke length of the piston or plunger 246 to adjust the volume of particulate introduced into the fluid output by the pump. For example, the piston or plunger 246 may be stroked along a portion of the chamber 244 to partially fill the chamber with particulate decreasing the volume of particulate introduced into the fluid stream.

It should be appreciated that the fluid injection system 230 may employ other suitable mechanisms to orient the valve 242 with the stroke of the piston or plunger 246 rather than a servomotor. For instance, a gear box or a transmission may be used to translate the axial motion of the power source 236 into rotational motion that orients the valve 242 depending on the stroke direction of the piston or plunger 246.

As FIGS. 3A-C are not drawn to scale, FIGS. 3A-C depict only a portion of the chamber 244, and FIG. 3C depicts only a portion of the piston or plunger 246, which may be tens of feet in length. For example, the piston or plunger 246 may be up to 20 feet (6 m) in length, and the chamber 244 may be at least twice as long as the piston or plunger 246 in length to accommodate the stroke of the piston or plunger 246.

The fluid injection system as described herein enables the injection of proppant into large fractures that exceed 2 or more inches (5 cm) in width. The fluid injection system also facilitates the plugging of fractures in portions of the formation that may no longer be suitable for production or fractures that exceed 2 or more inches (5 cm) in width. The fluid injection system may also facilitate plugging of fractures that leak into a salt mine.

In addition to the embodiments described above, many examples of specific combinations are within the scope of the disclosure, some of which are detailed below:

Example 1: A fluid injection system for injecting a particulate in a fluid, comprising: a high-pressure pump operable to output the fluid from an outlet flow channel; a reservoir configured to hold the particulate; a valve assembly in fluid communication with the reservoir and the outlet flow channel of the pump, the valve assembly operable to discharge the particulate into a fluid stream output by the pump while the reservoir is sealed from the outlet flow channel of the pump.

Example 2: The fluid injection system of Example 1, wherein the particulate is of different shapes and sizes.

Example 3: The fluid injection system of Example 1, wherein the particulate is selected from the group consisting of rocks, sand, and proppant.

Example 4: The fluid injection system of Example 1, wherein the particulate comprises a dimension of 0.0004 inches (0.001 cm) to 4 inches (10 cm).

Example 5: The fluid injection system of Example 1, wherein the high-pressure pump is operable to output a pressure of 0 to 50,000 psi (345 MPa).

Example 6: The fluid injection system of Example 1, wherein the valve assembly comprises a T-port valve.

Example 7: The fluid injection system of Example 1, wherein the valve assembly comprises a chamber and a piston or plunger positioned in the chamber, the piston or plunger operable to reciprocate in the chamber to extract the particulate from the reservoir and discharge the particulate from the chamber into the outlet flow channel of the pump.

Example 8: The fluid injection system of Example 1, further comprising a power source operably connected to the valve assembly and comprising any one or combination of a second pump or a motor.

Example 9: The fluid injection system of Example 1, further comprising a fluid reservoir in fluid communication with the pump and configured to hold the fluid.

Example 10: The fluid injection system of Example 1, wherein the high-pressure pump comprises a network of high-pressure pumps.

Example 11: The fluid injection system of Example 1, further comprising a wellhead in fluid communication with the outlet flow channel to receive a mixture of the fluid and the particulate.

Example 12: A method of injecting a fluid mixed with a particulate into a well, comprising: operating a pump to output a fluid from an outlet flow channel; positioning ports of a valve of a valve assembly to be in fluid communication with a chamber of the valve assembly and a reservoir holding the particulate; moving a piston or plunger in the chamber to draw the particulate into the chamber from the reservoir; positioning the ports of the valve to be in fluid communication with the chamber and the outlet flow channel of the pump; and moving the piston or plunger towards the valve to discharge the particulate in the chamber into the outlet of the flow channel and mix the particulate with the fluid.

Example 13: The method of Example 12, wherein the particulate is of different shapes and sizes.

Example 14: The method of Example 12, wherein the particulate is selected from the group consisting of rocks, sand, and proppant.

Example 15: The method of Example 12, wherein the particulate comprises a dimension of 0.0004 inches (0.001 cm) to 4 inches (10 cm).

Example 16: The method of Example 12, wherein the fluid comprises cement.

Example 17: The method of Example 12, wherein operating the pump comprises outputting the fluid at a pressure of 0 to 20,000 psi (137.9 MPa).

Example 18: The method of Example 12, further comprising injecting the mixed fluid into a subterranean earth formation Example 19: The method of Example 12, wherein positioning the ports of the valve to be in fluid communication with the chamber and the outlet flow channel of the pump further closes off the reservoir from fluid communication with the outlet flow channel.

Example 20: A valve assembly for discharging a particulate, comprising: a valve comprising T-shaped ports; a chamber; and a piston or plunger positioned in the chamber and operably coupled to a power source, the piston or plunger configured to reciprocate in the chamber to draw a particulate from a reservoir into the chamber and discharge the particulate from the chamber depending on the position of the T-shaped ports of the valve.

This discussion is directed to various embodiments of the present disclosure. The drawing figures are not necessarily to scale. Certain features of the embodiments may be shown exaggerated in scale or in somewhat schematic form and some details of conventional elements may not be shown in the interest of clarity and conciseness. Although one or more of these embodiments may be preferred, the embodiments disclosed should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application, and the discussion of any embodiment is meant only to be exemplary of that embodiment, and not intended to suggest that the scope of the disclosure, including the claims, is limited to that embodiment.

Certain terms are used throughout the description and claims to refer to particular features or components. As one skilled in the art will appreciate, different persons may refer to the same feature or component by different names. This document does not intend to distinguish between components or features that differ in name but not function, unless specifically stated. In the discussion and in the claims, the terms "including" and "comprising" are used in an open-ended fashion, and thus should be interpreted to mean "including, but not limited to . . . ." Also, the term "couple" or "couples" is intended to mean either an indirect or direct connection. In addition, the terms "axial" and "axially" generally mean along or parallel to a central axis (e.g., central axis of a body or a port), while the terms "radial" and "radially" generally mean perpendicular to the central axis. The use of "top," "bottom," "above," "below," and variations of these terms is made for convenience, but does not require any particular orientation of the components.

Reference throughout this specification to "one embodiment," "an embodiment," or similar language means that a particular feature, structure, or characteristic described in connection with the embodiment may be included in at least one embodiment of the present disclosure. Thus, appearances of the phrases "in one embodiment," "in an embodiment," and similar language throughout this specification may, but do not necessarily, all refer to the same embodiment.

Although the present disclosure has been described with respect to specific details, it is not intended that such details should be regarded as limitations on the scope of the disclosure, except to the extent that they are included in the accompanying claims.

What is claimed is:

1. A fluid injection system for injecting a particulate in a fluid into a well extending through a subterranean formation, comprising:

a pump operable to output the fluid from an outlet flow channel;

a particulate reservoir configured to hold the particulate; and a valve assembly in fluid communication with the particulate reservoir and the outlet flow channel of the pump, the valve assembly operable to discharge the particulate into a fluid stream output by the pump while the particulate reservoir is sealed from the outlet flow channel of the pump.

2. The fluid injection system of claim 1, wherein the particulate is of different shapes and sizes.

3. The fluid injection system of claim 1, wherein the particulate is selected from the group consisting of rocks, sand, and proppant.

4. The fluid injection system of claim 1, wherein the particulate comprises a dimension of 0.0004 inches (0.001 cm) to 4 inches (10 cm).

5. The fluid injection system of claim 1, wherein the pump is a high-pressure pump operable to output a pressure of 0 to 50,000 psi (345 MPa).

6. The fluid injection system of claim 1, wherein the valve assembly comprises a T-port valve.

7. The fluid injection system of claim 1, wherein the valve assembly comprises a chamber and a piston or plunger positioned in the chamber, the piston or plunger operable to reciprocate in the chamber to extract the particulate from the particulate reservoir and discharge the particulate from the chamber into the outlet flow channel of the pump.

8. The fluid injection system of claim 1, further comprising a power source operably connected to the valve assembly and comprising any one or combination of a second pump or a motor.

9. The fluid injection system of claim 1, further comprising a fluid reservoir in fluid communication with the pump and configured to hold the fluid.

10. The fluid injection system of claim 1, wherein the pump comprises a network of high-pressure pumps.

11. The fluid injection system of claim 1, further comprising a wellhead in fluid communication with the outlet flow channel to receive a mixture of the fluid and the particulate before being injected into the well.

12. A method of injecting a fluid mixed with a particulate into a well, comprising:

operating a pump to output a fluid from an outlet flow channel;

positioning ports of a valve of a valve assembly to be in fluid communication with a chamber of the valve assembly and a reservoir holding the particulate;

moving a piston or plunger in the chamber to draw the particulate into the chamber from the reservoir;

positioning the ports of the valve to be in fluid communication with the chamber and the outlet flow channel of the pump; and moving the piston or plunger towards the valve to discharge the particulate in the chamber into the outlet of the flow channel and mix the particulate with the fluid.

13. The method of claim 12, wherein the particulate is of different shapes and sizes.

14. The method of claim 12, wherein the particulate is selected from the group consisting of rocks, sand, and proppant.

15. The method of claim 12, wherein the particulate comprises a dimension of 0.0004 inches (0.001 cm) to 4 inches (10 cm).

16. The method of claim 12, wherein the fluid comprises cement.

17. The method of claim 12, wherein operating the pump comprises outputting the fluid at a pressure of 0 to 20,000 psi (137.9 MPa).

18. The method of claim 12, further comprising injecting the mixed fluid into a subterranean earth formation.

19. The method of claim 12, wherein positioning the ports of the valve to be in fluid communication with the chamber and the outlet flow channel of the pump further closes off the reservoir from fluid communication with the outlet flow channel.

20. A valve assembly for discharging a particulate, comprising:

a valve comprising T-shaped ports;

a chamber; and a piston or plunger positioned in the chamber and operably coupled to a power source, the piston or plunger configured to reciprocate in the chamber to draw the particulate from a reservoir into the chamber and discharge the particulate from the chamber depending on the position of the T-shaped ports of the valve.

* * * * *